United States Patent [19]

Witte

[11] 4,413,453

[45] Nov. 8, 1983

[54] SWIMMING POOL CONSTRUCTION

[75] Inventor: Donald H. Witte, Arlington, Tex.

[73] Assignees: Carl R. Meyer; Carol S. Meyer, both of Port Isabel, Tex.

[21] Appl. No.: 131,222

[22] Filed: Mar. 17, 1980

[51] Int. Cl.[3] ..... E04H 3/16; E04H 3/18

[52] U.S. Cl. ..... 52/127.1; 4/506; 52/127.3; 52/169.7; 52/249; 52/265; 52/300; 52/716; 52/747

[58] Field of Search ..... 52/169.7, 169.8, 300, 52/828, 249, 265, 127, 747, 146, 309.7, 309.16, 716, 222, 741, 745, 127.1, 127.3; 4/506

[56] References Cited

U.S. PATENT DOCUMENTS

| | | | |
|---|---|---|---|
| 1,924,414 | 8/1933 | Ring | 52/127 X |
| 2,042,797 | 6/1936 | Nechin | 52/588 X |
| 2,360,285 | 10/1944 | Sherman | 52/747 X |
| 2,490,272 | 12/1949 | Kascle | 52/169.7 |
| 2,533,041 | 12/1950 | Plummer | 52/152 X |
| 2,948,047 | 8/1960 | Peeler et al. | 52/741 X |
| 3,031,801 | 5/1962 | Leuthesser | 52/169.7 X |
| 3,057,119 | 10/1962 | Kessler | 52/222 X |
| 3,059,243 | 10/1962 | Ross et al. | 52/167.7 X |
| 3,094,709 | 6/1963 | Miccio et al. . | |
| 3,113,403 | 12/1963 | MacMillan, Jr. et al. | 52/152 X |
| 3,274,621 | 9/1966 | Diemond et al. | 52/169.7 X |
| 3,335,430 | 8/1967 | Schwarz et al. | 52/169.7 X |
| 3,409,916 | 11/1968 | Billig et al. | 52/146 |
| 3,511,002 | 5/1970 | Fox | 52/169.8 X |
| 3,518,704 | 7/1970 | Shanni . | |
| 3,745,593 | 7/1973 | Wall | 52/169.7 X |
| 3,750,197 | 8/1973 | Weir et al. | 52/169.7 |
| 3,798,857 | 3/1974 | Barrera | 52/169.8 |
| 3,976,269 | 8/1976 | Gupta | 52/828 |
| 4,024,684 | 5/1977 | Holmgren | 52/127 |
| 4,077,173 | 3/1978 | Rozanski | 4/506 X |
| 4,109,324 | 8/1978 | Cornelius . | |
| 4,124,907 | 11/1978 | Laven . | |
| 4,167,084 | 9/1979 | Brunton | 52/169.7 |

FOREIGN PATENT DOCUMENTS

| | | | |
|---|---|---|---|
| 1197310 | 6/1959 | France | 52/584 |
| 664405 | 1/1952 | United Kingdom | 52/82 |
| 1182244 | 2/1970 | United Kingdom | 52/716 |
| 1305765 | 2/1973 | United Kingdom . | |
| 1358815 | 7/1974 | United Kingdom . | |
| 1474934 | 5/1977 | United Kingdom . | |

*Primary Examiner*—Alfred C. Perham
*Attorney, Agent, or Firm*—Bacon & Thomas

[57] ABSTRACT

A swimming pool wall, for placement in an excavation, is made up of a series of bendable plates having only vertical flanges for stiffening while permitting shaping the wall to a selected outline. A resilient coping strip embraces the upper edge of the wall and houses a rigid metal bar to retain the upper edge of the wall in the desired configuration while other braces, at the lower edge of the wall extend from the plates to the outer edge portions of the flanges to securely maintain the lower edge of the wall in the desired configuration. Vertical Z-shaped bars are secured to certain of the plates to further stiffen them and further braces, secured to the flanges, extend diagonally upward into a concrete apron, selected ones of the diagonal braces carrying a form plate for defining the outer edge of the apron. Rigid bars are used to hold corner plates to a desired curvature during assembly of the pool wall and its placement in the excavation. After back-filling and forming the apron, those bars are removed.

11 Claims, 10 Drawing Figures

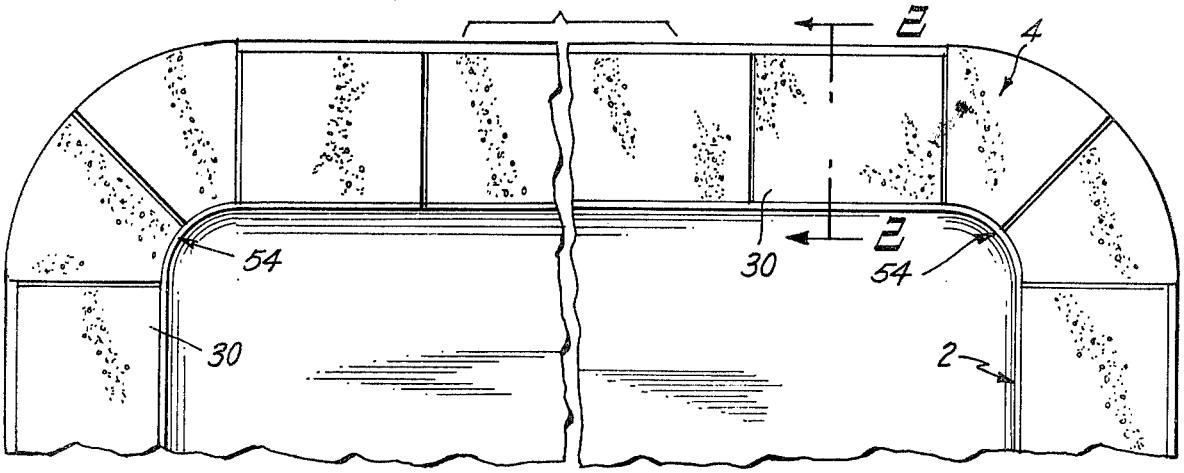
Fig. 1
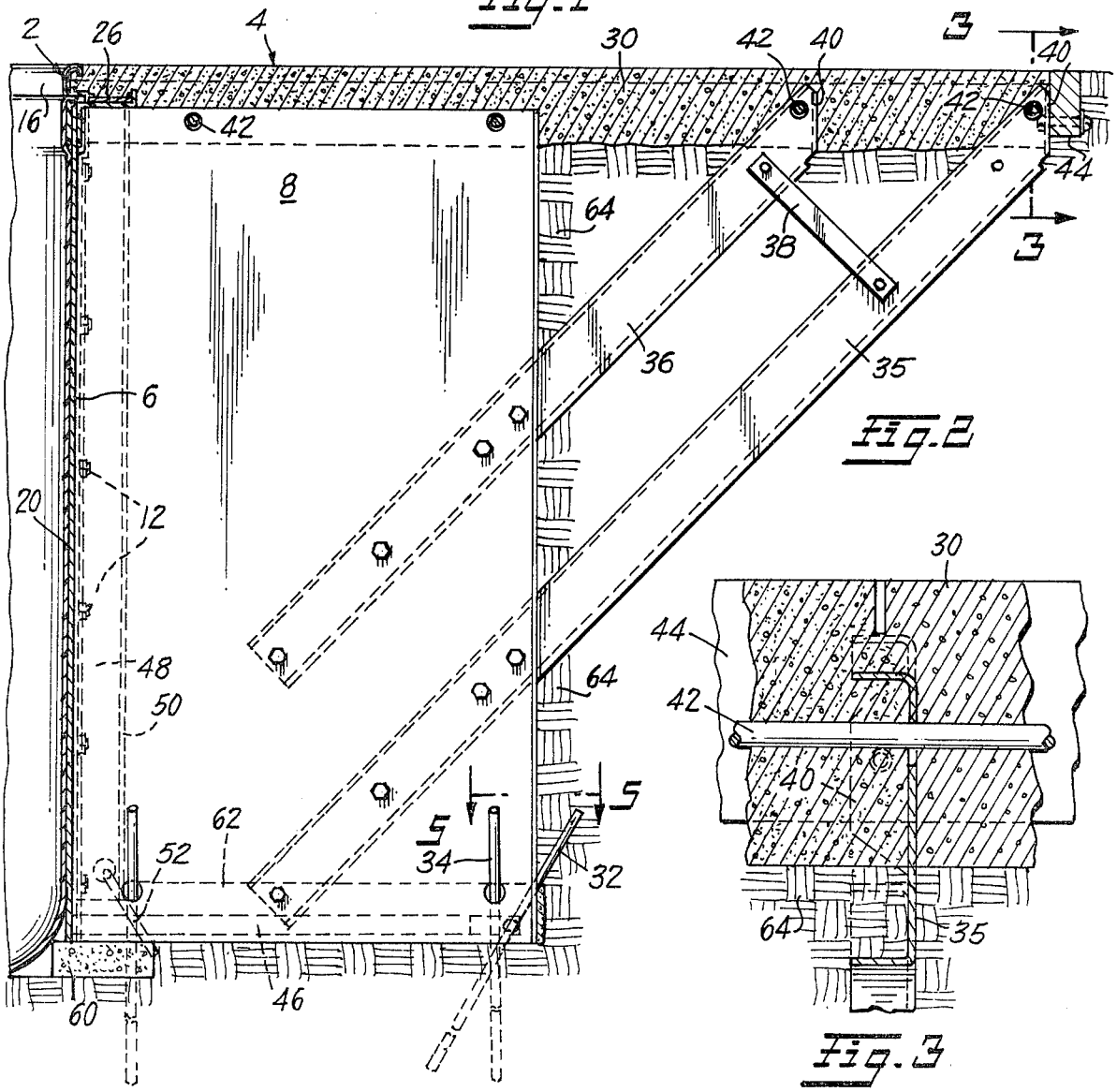
Fig. 2
Fig. 3

SWIMMING POOL CONSTRUCTION

BACKGROUND OF THE INVENTION

This invention is in the field of swimming pools.

In constructing a popular form of swimming pool, an excavation is first made at the site, and an upstanding wall is erected to define the desired outline of the pool. The wall must be sufficiently self-sustaining to hold its shape and of the desired outline even before any backfilling occurs around the outer periphery of the excavation. It is also desirable to form the upstanding wall of as inexpensive material as possible, and it is customary to construct such walls of sheet metal or the like. However, in erecting the wall it is essential that it outline be accurately maintained and to insure such accurate outline, it has been customary to provide the plates of the wall with upper and lower flanges and in most cases and flanges to bolt the units together. Such units, however, are of a predetermined and fixed shape, which cannot be altered to construct pools of different outlines. See, for example, U.S. Pat. Nos. 3,518,704, 3,798,857, 4,109,324 and 4,124,907. The above patents all disclose swimming pools of the general type mentioned in which the wall units are provided with either upper and lower flanges or are pan-shaped having flanges all the way around. U.S. Pat. No. 3,518,704 also discloses the use of braces to support a deck extending outwardly from the upper edge of the pool.

The present invention provides means for forming a swimming pool of any desired shape from identical modular units, each comprising a sheet of metal having a single flange at one vertical edge to extend outwardly of the pool, thus providing vertical stiffening. The plates are thus bendable to any desired shape. To maintain the plates in their desired configuration until final completion of the pool, applicant provides a stiffening coping extending around the upper edge of the pool wall which coping not only provides a finished edge, but provides, by means of a steel or other rigid bar therein, stiffening to maintain straight sections of the pool wall truly straight, and curved sections in the desired curvature. The pool is also provided with an outwardly extending deck around the upper edge which is braced to the sidewalls of the pool by means of bracing secured to the sidewalls and particularly the rearwardly extending flanges. It is preferred that a pair of braces, vertically spaced, be provided at each flange, the upper ends of those braces being adapted to have a mold plate secured thereto to define the outer edge of a concrete deck to be poured later. The invention also contemplates the provision of bottom braces to hold the bottom edge of the upstanding wall in the desired accurately maintained shape during construction of the pool. Applicant also contemplates the provision of additional Z-shaped bars which may be attached to the modular plates intermediate the main flanges of the pool wall to further assist in stiffening the same and a novel means and method are contemplated for maintaining curved sections to the desired curvature, without influencing adjacent modules, until the pool has been rigidly secured in place in its excavation.

BRIEF DESCRIPTION OF THE DRAWINGS

FIG. 1 is a fragmentary plan view of the swimming pool of the present invention;

FIG. 2 is an enlarged fragmentary vertical sectional view, taken on the line 2—2 of FIG. 1;

FIG. 3 is a further enlarged fragmentary vertical sectional view, taken on the line 3—3 of FIG. 2;

DESCRIPTION OF A PREFERRED EMBODIMENT

FIG. 1 is a plan view of the end portion of an exemplary swimming pool wherein the upstanding wall of the pool is provided with a coping 2 extending the entire length thereof to provide a finished corner edge between the upstanding sidewall and a concrete apron 4 extending outwardly therefrom.

Figure 9:
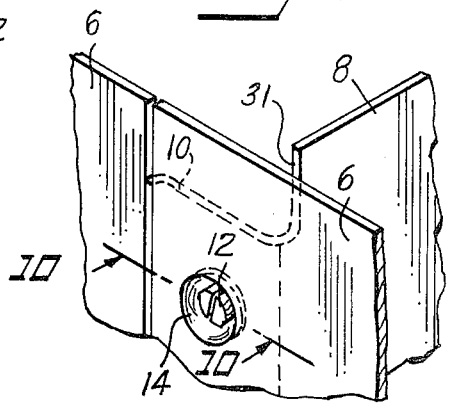
FIG. 9 is a fragmentary isometric view taken at a panel joint, showing the slot in the rearwardly extending flange to receive the depending leg of the coping.

The pool wall is constructed of modular plates 6, of sheet metal or other suitable material, each having a rearwardly extending flange 8 bent therefrom (see FIG. 9). Each flange 8 is at the edge of a stepped portion 10 of the adjacent end of a plate 6 which stepped portion is substantially equal to the thickness of a plate 6, so that when the plates are assembled with the type of joint shown in FIG. 9, the inner surfaces of those plates define a continuous coplanar surface.

The free edge of one plate 6 is seated in the step 10, and bolted to the adjacent plate by means of fasteners 12 seated in embossed recesses 14. The recesses 14 are provided in both the plates 6 by pressing a small area of the plates outwardly and serve to house the fasteners 12 without protrusions inwardly of the pool. The structure thus far described is the subject of the copending application of Werner L. Kleinert described and claimed in application Ser. No. 131,800 filed Mar. 19, 1980, and is shown and described herein merely to complete the disclosure and provide a proper basis for the present invention.

Figure 6:
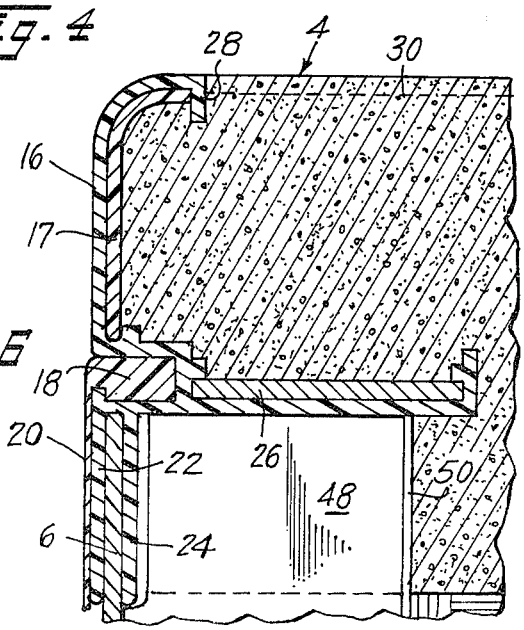
FIG. 6 is an enlarged fragmentary vertical sectional view through the coping showing particularly the Z-shaped reinforcing brace.

According to the present invention, the upper edge of the upstanding wall defined by plates 6 is capped by a resilient coping member 16 (FIG. 6), having a recess therein to receive and hold the bead 18 of a flexible pool liner 20. The use of such liners is conventional and need not be described further. The coping 16 is provided with depending flanges 22 and 24 embracing the upper edge portions of the plates 6 and a rearwardly extending portion defining an upwardly facing channel in which a rigid steel bar 26 is placed to rigidify the structure. As shown, the rearwardly extending portion containing the bar 26 rests directly on the reinforcing flanges 8 previously described and on any Z-shaped bars which will be described. The coping member 16 is also provided with an upper curved corner defining portion and a depending flange 28, which may be interlocked with any suitable deck structure, such as the concrete slab 30 shown in FIG. 6. As best seen in FIG. 9 the upper end portion of step 10 and flange 8 are notched, as at 31 to accommodate the continuous outer flange 24 of the coping 16. Numeral 17 designates a connector element spanning the joint between abutting ends of lengths of coping 16.

Referring now to FIG. 2, numerals 32 and 34 denote stakes that may be provided and driven through openings in the flange 8 for the purpose of anchoring the edges of those flanges to the ground while the pool is being constructed. Also shown in FIG. 2 are diagonally upwardly and rearwardly extending braces 35 and 36. These braces are shown as being of sheet metal and of channel shape, and are bolted to the flanges 8 to extend upwardly and rearwardly in substantially parallel relation and a tension member 38 secured to each of the braces principally to support brace 35, when present, since it is a longer cantilever than brace 36. At their upper ends, the braces 35 and 36 are configured to define vertical end faces 40, which may be in the form of flanges extending from the sidewall of the braces and in constructing the pool, concrete reinforcing rods 42 are extended throughout the upper ends of the braces to provide metal reinforcement for the concrete slab 30. The vertical faces 40 and the braces serve to selectively position a form plate 44 constituting an outer mold surface for the concrete slab 30, thus determining its width. The form plates may be selectively mounted on the brace 35 for a slab of maximum width or may be mounted on the end of brace 36 and brace 35 may be omitted when an intermediate width slab is desired. Also, both braces 35 and 36 may be omitted and plate 44 mounted directly on the rear edges of flanges 8 when a narrow apron is desired.

Figure 4:
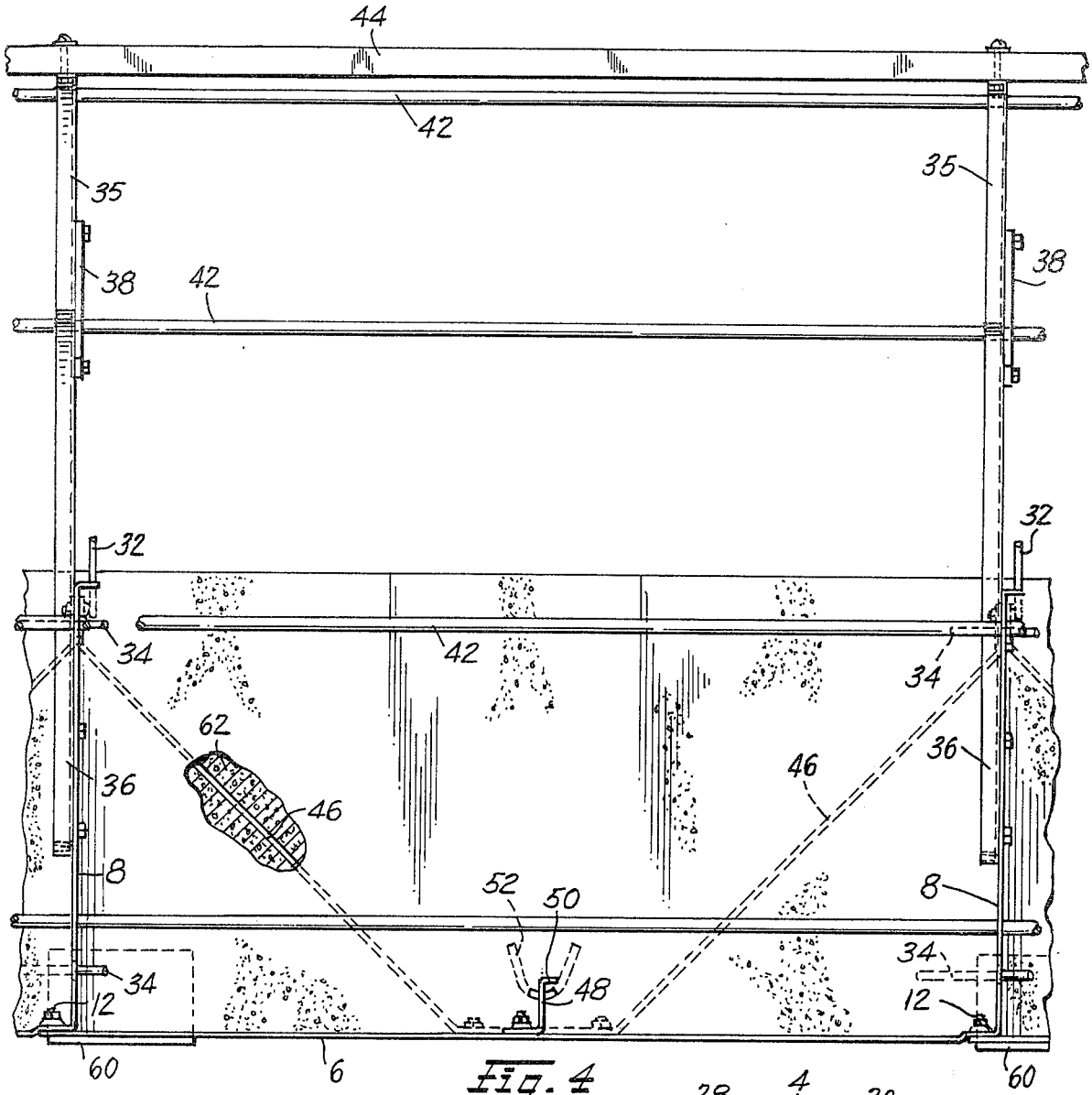
FIG. 4 is a fragmentary plan view of the framework structure of FIG. 2, the concrete decking being omitted for purposes of clarity.
Figure 5:
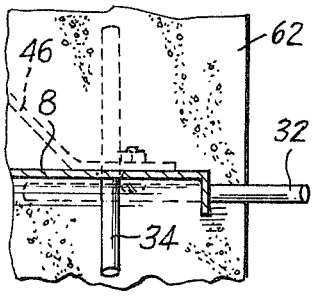
FIG. 5 is a further enlarged fragmentary horizontal sectional view, taken on the line 5—5 of FIG. 2.

To maintain the lower edge of the upstanding wall of the pool in the desired configuration during construction, applicant also provides generally V-shaped braces 46 (see FIG. 4), having their central portions bolted to the plates 6 at approximately their mid regions and having arms extending diagonally and rearwardly therefrom to the rear edge portions of the flanges 8. At their rear ends, the braces 46 are secured to the flanges 8 and thus constitute a rigidifying means which can be adapted to positively hold the lower edge of the pool wall in any desired configuration during construction, either straight or curved in either a horizontal or vertical plane, or both. FIG. 4 also shows a generally Z-shaped stiffener bar 48 having its forward edge secured to the plates 6 and having a rear narrow flange 50. Thus, the bar 48 serves to further rigidify and stiffen the sidewall plates. As shown in FIG. 4, the lower end of the reinforcing or stiffening bar 48 may have an anchor rod 52 at its lower end to be embedded in concrete as will be described later.

Figure 7:
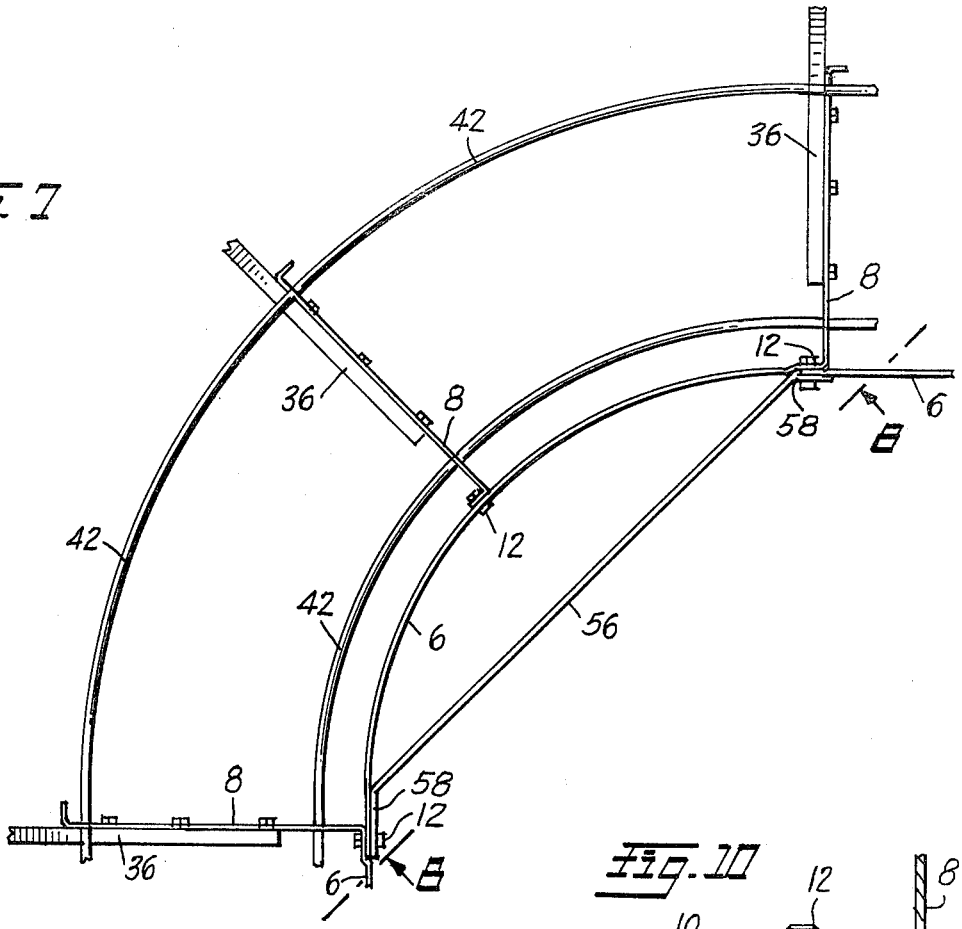
FIG. 7 is a fragmentary plan view of the framework structure at a corner of the swimming pool, on a reduced scale.
Figure 10:
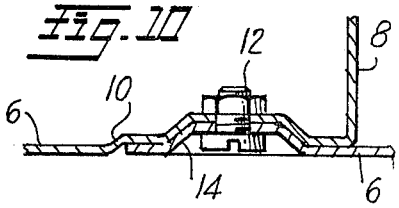
FIG. 10 is an enlarged fragmentary horizontal sectional view taken on the line 10—10 of FIG. 9.
Figure 8:
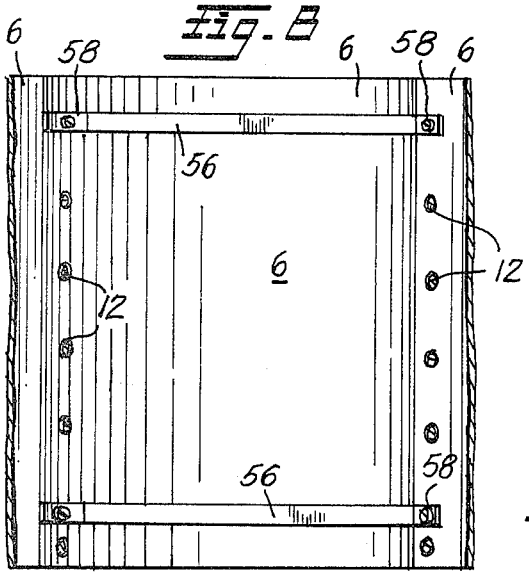
FIG. 8 is an elevational view of the corner of the pool, partly in section, showing the struts for temporarily holding the curved corners, taken on the line 8—8 of FIG. 7.

It is also customary to form swimming pools of this type with curved rather than square corners, such as shown at 54 in FIG. 1. In initially constructing the swimming pool wall with such curved corners, it is difficult to maintain the corner at the proper curvature, without transmitting bending forces to the adjacent plates of the sidewall which should be maintained in straight condition and truly tangent to the curve. FIGS. 7 and 8 herein depict applicant's method and means for properly forming the curved corner portion 54. As shown, a plate 6 to be curved is secured to adjacent plates 6 intended to extend tangentially from the curved plate in the finished pool without residual curvature in those plates. To effect proper forming of the corner, applicant secures the three plates together, the middle one of which is to be curved and by applying forces to the outer plates, the curvature of the plate 6 in the middle is produced. To maintain that curvature while relieving the end plates of all stress, applicant provides a strut or bar 56 having end portions 58 provided with openings through which fastening means 12 may pass to secure the strut to the ends of the middle plate 6 after it has been curved in the desired amount. Thereafter, the stress on the bending forces on the adjacent plates 6 may be relieved and they will then assume a true straight line configuration tangent to the curve of the median plate 6. Those struts are held to the structure by selected fasteners 12 which are also employed to secure adjacent plates together. After the pool has been completed, as will be described, the struts 56 may be removed and the selected fasteners 12 replaced in the plates and the desired curve at the corner of the pool is maintained. As shown in FIG. 8, at least two of the struts 56 are employed, an upper one adjacent the upper edge of the wall and a lower one adjacent the lower edge thereof.

In constructing a swimming pool of the type described herein, an excavation is first formed at the site, the excavation being large enough to provide excavated areas outside the intended position of the pool wall. Thus, the builder has room to work in that region outside of the wall to assemble the various plates as described. When the entire pool wall has been assembled as described herein, it can be placed on suitable blocks 60 (see FIG. 2), or otherwise supported, for maintaining the wall at the desired elevation and level, concrete may be poured about the lower edge portion of the pool, such as shown at 62 in FIG. 4. This concrete then permanently and positively rigidifies the lower edge of the pool wall and holds the same rigidly in the desired configuration. Thereafter, earth backfill 64 may be placed (see FIG. 2) to back up and further support the plates 6 on their outer sides. Thereafter, the concrete apron 30 may be poured and the pool is then completed.

While a single specific embodiment of the invention has been shown and described herein, the same is merely illustrative of the principles involved and further embodiments may be adopted within the scope of the appended claims.

I claim:

1. In a swimming pool construction having an upstanding wall defined by a plurality of substantially identical modular units, with each unit including a sheet of bendable material having an integral vertical flange at one end thereof extending perpendicular thereto and outwardly of the pool for a substantial distance, the improvement comprising an integral coping member of resilient material extending along the upper edge of the wall and including:

(a) depending flanges extending continuously along and embracing the upper edge of the wall;

(b) a substantially horizontal outwardly extending portion freely supported by the upper edge of each vertical flange and defining an upwardly facing channel; and (c) rigid reinforcing means disposed in the channel and extending throughout the length of the upper edge of the wall for determining and maintaining the desired shape of the upper edge of the wall.

2. The swimming pool construction of claim 1 wherein the modular units and a portion of each vertical flange are notched for receiving the outermost one of the depending flanges.

3. The swimming pool construction of claim 1 further including a Z-shaped stiffening member carried by the outer face of at least one of the modular units and extending generally vertically between adjacent vertical flanges, with the outwardly extending portion of the coping member engaging the upper end of the stiffening member.

4. In a swimming pool construction having an upstanding wall defined by a plurality of substantially identical modular units, with each unit including a sheet of bendable material having an integral vertical flange at one end thereof extending perpendicular thereto and outwardly of the pool, the improvement comprising:

(a) a pool apron of concrete extending outwardly from the upper edge of the wall and beyond the outermost edges of the flanges;

(b) each flange extending outwardly of the pool for a sufficient distance to define substantially the only portion of each modular unit for supporting vertical compression loading imposed by the outward extension of the apron;

(c) at least one elongate bracing member;

(d) means for rigidly connecting one end of the bracing member to the flange at a location above the lowermost edge of the flange so that the bracing member:

1. extends upwardly and outwardly from the connection location to define a cantilevered support for sustaining substantially all vertical compression loading imposed by the portion of the apron extending beyond the outermost edge of the flange; and 2. the vertical compression loading sustained by the bracing member is transmitted to and supported substantially only by the flange; and (e) reinforcing means carried by the upper ends of the bracing members.

5. The swimming pool construction of claim 4 further including a plurality of bracing members and means extending between and secured to the bracing members of each flange for maintaining the bracing members in a substantially parallel relationship during construction of the pool.

6. The swimming pool construction of claim 4 further including a substantially V-shaped brace means secured at its apex to approximately the mid-portion of each modular unit, with the brace means including diverging arms secured to the outer edge portions of adjacent flanges of adjacent modular units for maintaining the desired shape and vertical disposition of the wall.

7. The swimming pool construction of claim 6 wherein the V-shaped brace is secured to the modular unit adjacent the bottom edge thereof and the diverging arms are secured to the outer edge portions of adjacent flanges adjacent the bottom thereof.

8. The swimming pool construction of claim 7 further including a body of concrete extending around at least the lower edge of the wall, with the lower ends of the flanges and the V-shaped brace being embedded in the concrete.

9. In a swimming pool construction having an upstanding wall defined by a plurality of substantially identical modular units, with each unit including a sheet of bendable material having an integral vertical flange at one end thereof extending perpendicular thereto, the improvement comprising:

(a) a pool apron of concrete extending outwardly from the upper edge of the wall;

(b) each flange extending outwardly of the pool for a sufficient distance to define substantially the only means for supporting vertical compression loading imposed by the apron;

(c) a plurality of elongate bracing members carried by each flange, with each bracing member having one end secured to the lower portion of each flange above the lowermost edge thereof and extending upwardly and outwardly therefrom, with its other end being embedded in the concrete of the apron, whereby substantially all vertical compression loading imposed from above the bracing members is transmitted to and supported substantially only by their corresponding flange;

(d) at least one reinforcing rod extending through the upper ends of the corresponding bracing members of adjacent flanges and being embedded in the concrete of the apron;

(e) means extending between and secured to the bracing members of each flange for maintaining the bracing members in a substantially parallel relationship during construction of the pool; and (f) an upstanding plate for defining a boundary form for the apron, with the upper ends of the bracing members being selectively engageable by the upstanding plate to permit forming an apron of a desired width.

10. An arrangement for maintaining a predetermined curvature during construction of a portion of a swimming pool having a plurality of substantially identical modular units secured together in end-to-end relation by means of fasteners extending through adjacent portions of adjacent units and each unit including a sheet of substantially smooth bendable material having an integral vertical flange at one end thereof extending perpendicular thereto, at least one of the units being bent under tension to the predetermined curvature, the arrangement including at least one rigid member extending chordally of the curved unit and having its opposite ends secured by the fasteners adjacent corresponding flanges of the one unit and an adjacent unit to thereby maintain the one unit in the predetermined curvature under tension until substantial completion of the swimming pool.

11. A method of forming and maintaining a desired curvature in a portion of a swimming pool wall defined by a plurality of substantially identical modular units secured together in end-to-end relation by means of fasteners extending through adjacent portions of adjacent units and each unit including a sheet of substantially smooth bendable material having an integral vertical flange at one end thereof extending perpendicular thereto, comprising the steps of:

(a) applying forces to opposed ends of a unit in a manner to cause the unit to assume a desired curvature under tension;

(b) securing opposite ends of a rigid bar to the opposed ends of the curved unit by the fasteners adjacent corresponding flanges of the one unit and an adjacent unit to extend chordally thereacross for maintaining the unit in the desired curvature;

(c) securing additional units to the curved unit to complete the swimming pool wall in a desired configuration;

(d) rigidly securing the upper and lower edges of the wall; and (e) removing the rigid bar from the curved unit.

* * * * *